US011293140B2

(12) United States Patent
Feng

(10) Patent No.: US 11,293,140 B2
(45) Date of Patent: Apr. 5, 2022

(54) WET PART OF FOURDRINIER

(71) Applicant: Shenzhen De Wei Fiber Environmental Protection Technology CO., Ltd., Guangdong (CN)

(72) Inventor: Shan Feng, Shenzhen (CN)

(73) Assignee: Shenzhen De Wei Fiber Environment Protection Technology Co., Ltd., Guangdong (CN)

( * ) Notice: Subject to any disclaimer, the term of this patent is extended or adjusted under 35 U.S.C. 154(b) by 0 days.

(21) Appl. No.: 16/651,325

(22) PCT Filed: Sep. 26, 2018

(86) PCT No.: PCT/CN2018/107628
§ 371 (c)(1),
(2) Date: Mar. 26, 2020

(87) PCT Pub. No.: WO2019/062765
PCT Pub. Date: Apr. 4, 2019

(65) Prior Publication Data

US 2020/0232163 A1 Jul. 23, 2020

(30) Foreign Application Priority Data

Sep. 26, 2017 (CN) ..... 201710877764.2

(51) Int. Cl.
*D21F 3/10* (2006.01)
*D21F 1/02* (2006.01)
(Continued)

(52) U.S. Cl.
CPC ..... *D21F 3/10* (2013.01); *D21F 1/02* (2013.01); *D21F 1/40* (2013.01); *D21F 3/08* (2013.01)

(58) Field of Classification Search
CPC ..... D21F 3/10; D21F 1/02; D21F 1/40; D21F 3/08; D21F 9/00; D21F 3/04; D21F 1/00; D21F 3/02; D21F 3/00
See application file for complete search history.

(56) References Cited

U.S. PATENT DOCUMENTS 4,123,320 A * 10/1978 Stone ..... D21F 3/02 162/199
4,285,766 A * 8/1981 Kankaanpaa ..... D21F 2/00 162/199

FOREIGN PATENT DOCUMENTS

CN 1465810 A * 1/2004

* cited by examiner

*Primary Examiner* — Jacob T Minskey
*Assistant Examiner* — Matthew M Eslami
(74) *Attorney, Agent, or Firm* — Raymnond Y. Chan; David and Raymond Patent Firm

(57) ABSTRACT

A forming section, commonly called wet part, of a fourdrinier machine includes a rotatable breast roll, a rotatable couch roll, a forming mesh disposed between said breast roll and said couch roll, wherein said forming mesh is tangent to a lower portion of said couch roll, a fabric mesh which is tangent to said couch roll, wherein the tangent point of said fabric mesh and said couch roll coincides with or is located front of the tangent point of said forming net and said couch roll, wherein said fabric mesh and said forming net are attached to part of the outer surface of said couch roll in an inner and outer manner, a dewatering unit disposed on the rear surface of said forming mesh, a headbox disposed above said breast roll for flowing pulp slurry to said forming mesh and a press roll disposed against on said couch roll to form a pressing zone between said press roll and said couch roll so as to press and dewater said wet fiber web formed on said forming mesh on the surface of said fabric mesh.

18 Claims, 2 Drawing Sheets

(51) Int. Cl.
*D21F 1/40* (2006.01)
*D21F 3/08* (2006.01)

WET PART OF FOURDRINIER

CROSS REFERENCE OF RELATED APPLICATION

This is a U.S. National Stage under 35 U.S.C. 371 of the International Application Number PCT/CN/2018/107628, filed Sep. 26, 2018, which claims priority to Chinese application number 201710877764.2, filed Sep. 26, 2017.

BACKGROUND OF THE PRESENT INVENTION

Field of Invention

The present invention relates to a technology of paper making machine, and more particularly to a wet part (forming section) of a fourdrinier machine for making paper.

Description of Related Arts

At present, the fourdrinier machine is the most widely used paper-making machine, and the forming section, commonly called the wet part, is a critical part or component of the fourdrinier machine. There are mainly two kinds of conventional forming section. Referring to in FIG. 1, one of conventional forming sections is illustrated, wherein pulp slurry transferred from the headbox 1' to the forming mesh 2' is firstly dewatered through the dewatering unit 3' to remove water in the pulp, and then the wet fabric web 8' is transported to a position between the couch roll 5' and the leading press roll 6' by the continuous sheet of fabric mesh 4' and the forming mesh 2' for mechanical squeezing to remove water in the wet fabric web 8'. Next, the wet fabric web 8' is transferred to the lower surface of the fabric mesh 4' to output. The disadvantage of this conventional structure is that the linear pressure between the couch roll 5' and the leading press roll 6 should not be too large, or otherwise the wet fabric web 8' will be crushed. Referring to FIG. 2, another conventional structure is illustrated, which utilities a negative pressure zone of the suction press roll 7' for dewatering. Then, a positive pressure zone of the suction press roll 7' is used to blow the wet fabric web 8' away from the forming mesh 2'. Thereafter, the paper fabric web 8' is further blown to the fabric mesh 4'. The disadvantages of this structure include poor dewatering ability, the wet fabric web 8' being easy to break, high power consumption, high manufacturing cost, and large noise.

SUMMARY OF THE PRESENT INVENTION

An objective of the present invention is to provide a forming section of a fourdrinier machine which solves the technical problems of poor dewatering ability and high power consumption in the prior art.

According to the present invention, the foregoing and other objectives and advantages are attained by a forming section of fourdrinier, comprising:

a rotatable breast roll;

a rotatable couch roll a forming mesh provided between the breast roll and the couch roll, wherein the forming mesh is extended tangential to a lower position of the couch roll defining a first tangent point;

a sheet of fabric mesh, such as a specially woven fabric mesh conveyor belt, which is also extended tangential to the couch roll at a second tangent point which is selectively coincided with or positioned before the first tangent point of the forming mesh and the couch roll, wherein at least an outer side of the fabric mesh and a corresponding inner side of the forming mesh are attached on a portion of an outer surface of the couch roll a dewatering unit provided at a rear side of the forming mesh;

a headbox arranged above the breast roll for flowing pulp contained in the headbox to the forming mesh; and a rotatable press roll arranged pressing against the couch roll, wherein a pressing zone is formed between the press roll and the couch roll for pressing and squeezing a wet fabric web formed on a front side of the forming mesh to remove water thereof.

Further, the forming section comprises a vacuum water suction unit arranged below the forming mesh and in front of the first tangent point of the couch roll and the forming mesh, wherein the vacuum water suction unit has a triangular or trapezoidal shape.

Further, the forming section comprises at least one scraping blade, such as down-squeegee, at the outer side of the couch roll and in contact with the forming mesh so as to prevent the water removed from wetting the wet fabric web again.

Further, a separation point of the fabric mesh and the forming mesh is located behind the pressing zone, and a transferring device is provided between the separation point and the pressing zone to transfer the wet fabric web on the forming mesh to the fabric mesh.

Further, the transferring device is embodied as a blower unit provided at a rear side of the forming mesh.

Further, a linear pressure between the press roll and the couch roll is larger than or equal to 400 kgf/cm.

Further, the linear pressure between the press roll and the couch roll is larger than or equal to 500 kgf/cm.

Further, the line pressure between the press roll and the couch roll is larger than or equal to 600 kgf/cm.

Further, a tension of the forming mesh is larger than or equal to 10 kgf/cm.

Further, a tension of the forming mesh is larger than or equal to 15 kgf/cm.

Further, an including angle of the forming mesh on the couch roll is larger than or equal to 60°.

The invention is advantageous in that it provides a forming section of fourdrinier machine which can process a mechanical pressing and squeezing for dewatering/dehydrating between the couch roll and the press roll, wherein due to the experimental result, a ultimate dryness of 48-50% can directly be attained by means of such mechanical dehydration, which is at least 2% higher than the highest dryness of the traditional pressing methods while saving 50-70% electrical power, saving 8-40% steam consumption, extending 1-2 times of the service life span of the fabric mesh, increasing 2-5 times of the wet strength of the paper made, improving at least 20% the dry strength of the paper made, increasing 3-5 percentage points of the papermaking rate (reducing the breaking of paper), reducing its cost to ½ to ⅓ of the manufacturing cost of the conventional machine so as to greatly reduce the manufacturing cost, reducing the maintenance cost of the invention to less than ⅕ of maintenance cost of the conventional machine. In addition, the operation of the invention is more simple, the labor intensity and the operation difficulty of the worker are lower. Since no equipment such as vacuum pump that generates high noise is required in the invention, the operating environment of the worker is greatly improved.

BRIEF DESCRIPTION OF THE DRAWINGS

In order to clearly illustrate the technical solutions in a preferred embodiment of the present invention, the drawings of the embodiment or the conventional art will be briefly described below. Apparently, the drawings in the following description are only some solutions of the present embodiment. For more embodiments, other drawings may be drawn by those of who skilled in the art without nonobvious hardworking.

Figure 1:
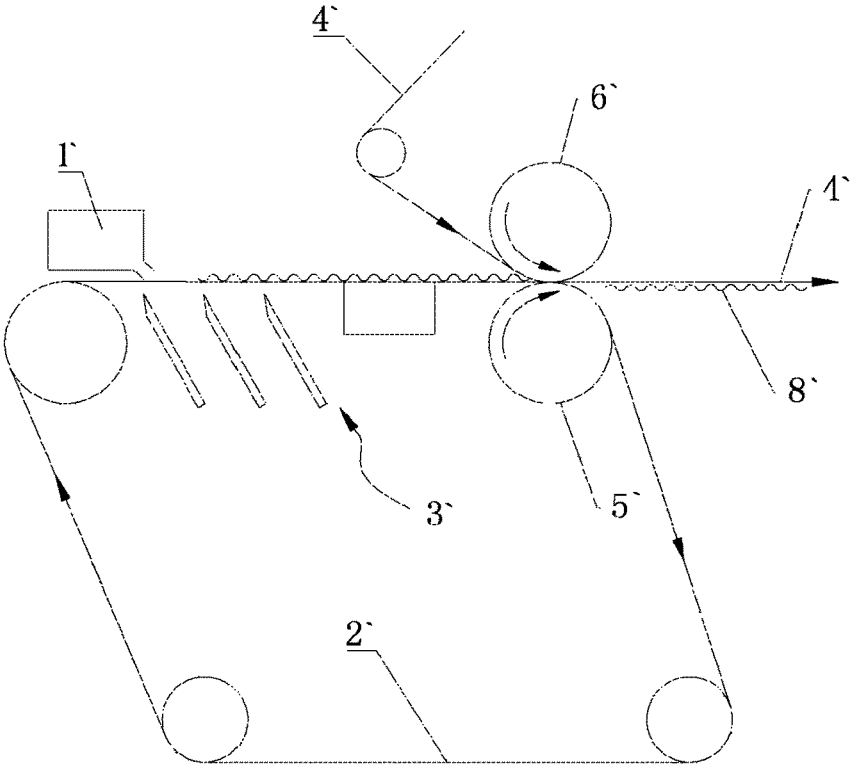
PRIOR ART Fig.1
FIG. 1 is a schematic structural view of a prior art.
Figure 2:
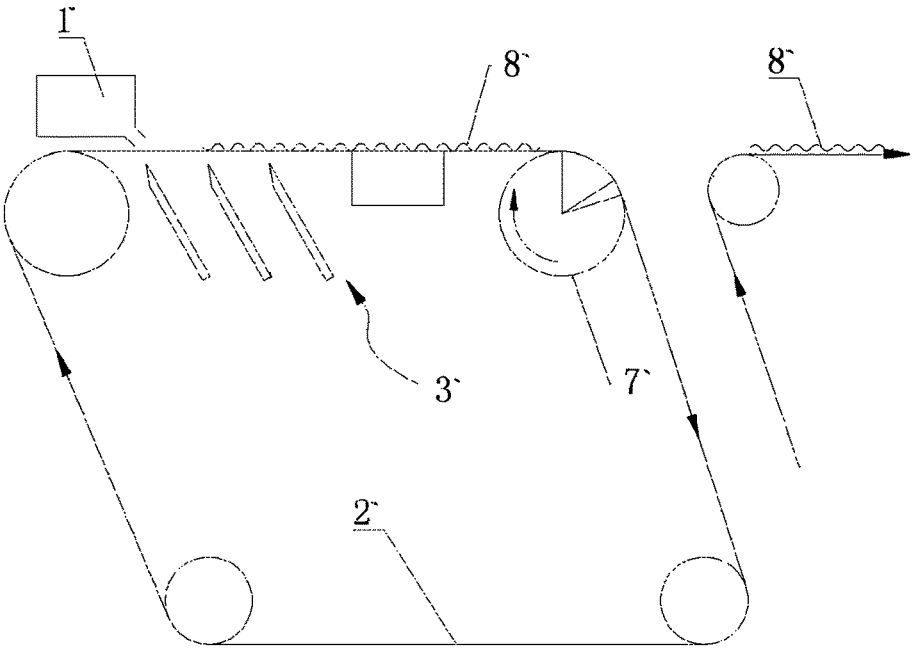
PRIOR ART Fig.2
FIG. 2 is a schematic structural view of another prior art.

In the drawing: 1—headbox; 2—forming mesh; 3—dewatering unit; 4—fabric mesh; 5—couch roll 6—leading press roll; 7—suction press roll; 8—wet fabric web; 9—breast roll; 10—press roll; 11—scraping blade; 12—blower unit; 13—fabric mesh roll; 14—vacuum water suction unit.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It is worth to mention that when an element is referred to as being "fixed" or "disposed" on the other element, it can be directly or indirectly on the other element. When an element is referred to as being "connected" to the other element, it can be directly connected to the other element or indirectly connected to the other element.

It should be understood that the terms "length", "width", "upper", "lower", "front", "rear", "left", "right", "vertical", "horizontal", "top", "bottom", "inside", "outside" and the like are illustrating orientation or positional relationship based on the orientation or positional relationship shown in the drawings, which is only for convenience of description of the present and simplified description, and does not indicate or imply the components must have a particular orientation, or be constructed and operated in a particular orientation, and thus are not to be construed as limiting of the present invention.

Moreover, the terms "first" and "second" are used for descriptive purposes only and are not to be construed as indicating or implying a relative importance or implicitly indicating the number of technical features. Thus, features defining "first" and "second" may include one or more of the features either explicitly or implicitly. In the description of the present invention, the "a plurality" means two or more unless specifically defined.

Figure 3:
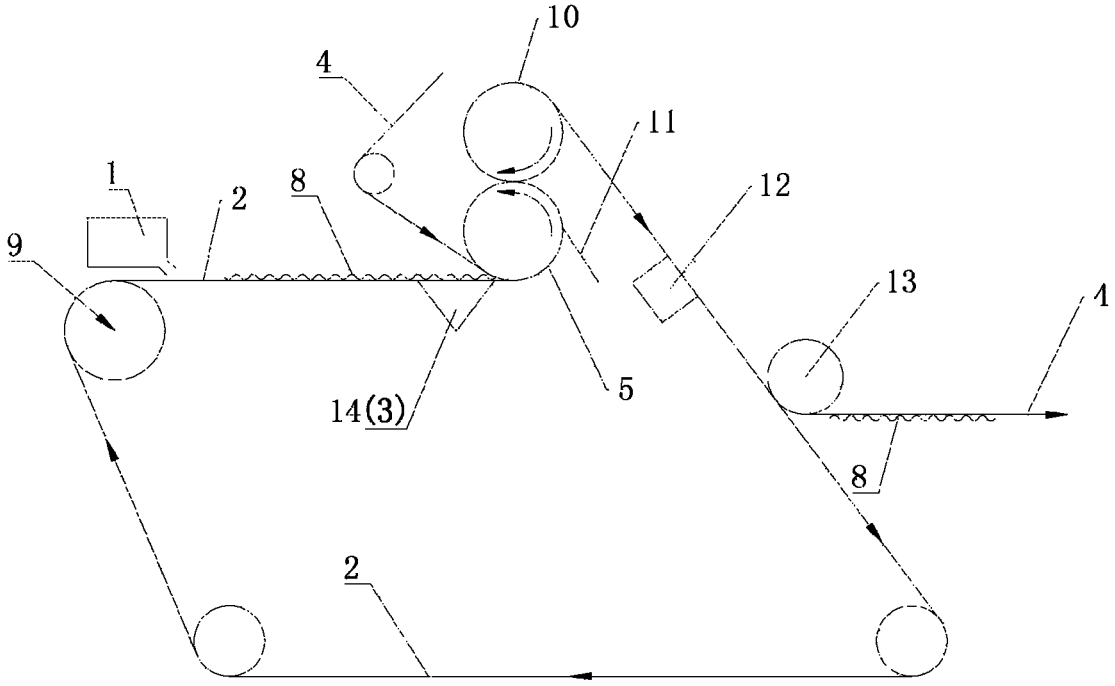
FIG. 3 is a schematic structural view illustrating a forming section of fourdrinier machine according to a preferred embodiment of the present invention.

Referring to FIG. 3, a forming section, commonly called wet part, of an elongated fourdrinier machine for paper making according to a preferred embodiment of the present embodiment is illustrated, wherein arrows as shown in the drawing indicate operating directions of the respective components, and the wavy line demonstrates a wet fabric web 8.

The forming section according to the preferred embodiment of the present invention comprises a rotatable breast roll 9 and a rotatable couch roll 5, a forming mesh 2 moveably provided between the breast roll 9 and the couch roll 5 selectively in either a horizontal arrangement or an inclined arrangement with a predetermined angle, and a headbox 1 arranged above the breast roll 9 for flowing a pulp slurry contained in the headbox 1 onto the forming mesh 2. It is worth mentioning that the description "above" does not means to be absolutely positioned right above. The forming mesh 2 is extended tangentially to a lower position of the couch roll 5, where the "lower position" includes any position lower than a horizontal center line of the couch roll 5. At the couch roll 5, a sheet of fabric mesh 4, such as a specially woven fabric mesh conveyor belt, is provided tangential to the couch roll 5 defining a second tangent point of the fabric mesh 4 and the couch roll 5, wherein the second tangent point is position before the first tangent point of the forming mesh 2 and the couch roll 5. In other words, the fabric mesh 4 contacts the couch roll 5 earlier than the forming mesh 2. Of course, the first and second tangent points may also be coincided. The outer side of the fabric mesh 4 and the inner side of the forming mesh 2 are overlappedly attached on a portion of an outer surface of the couch roll 5.

The forming section further comprises a vacuum water suction unit 14 arranged below the forming mesh 2 and disposed before the first tangent point of the couch roll 5 and the forming mesh 2. The vacuum water suction unit 14 has a triangular or trapezoidal shaped housing, such that, on one hand, a left oblique side of the vacuum water suction unit 14 as shown in FIG. 3 can be used as a dewatering unit 3 which is provided at a rear side of the forming mesh 2 for scraping off the water on the forming mesh 2 and forming a vacuum in a "wedge zone". On the other hand, a right oblique side of the vacuum water suction unit 14 as shown in FIG. 3 allows the water on the surface of the couch roll 5 flowing down to prevent the wet fabric web from getting wet by water again.

The forming section of the preferred embodiment further comprises a press roll 10 arranged pressing against the couch roll 5, wherein a pressing zone is formed between the press roll 10 and the couch roll 5 for pressing and squeezing the wet fabric web 8 formed on the surface of the forming mesh 2 to remove water of the wet fabric web 8 at the pressing zone. The pressing zone includes an area where the couch roll 5 in contacting with the press roll 10, which is theoretically a straight line between the couch roll 5 and the press roll 10 along an axial direction thereof.

According to the preferred embodiment of the present invention, the couch roll 5 and the press roll 10 can be used for mechanically pressing and squeezing to remove water such that, according to the experimental results, a ultimate dryness of 48-50% of mechanical dehydration/dewatering can be directly attained, which is at least 2% higher than the highest dryness of the conventional pressing and squeezing methods, while saving 50-70% electrical power, saving 8-40% steam consumption, extending 1-2 times of the service life span of the fabric mesh, increasing 2-5 times of the wet strength of the paper, improving at least 20% the dry strength of the paper made, increasing 3-5 percentage points of the papermaking rate (reducing the breaking of paper), reducing its cost to ½ to ⅓ of the manufacturing cost of the conventional machine so as to reduce the maintenance cost of the forming section of the present invention to less than ⅕ of the maintenance cost of the conventional machine. In addition, the operation of the equipment is more simple and the labor intensity and the operation difficulty of the worker are lower. Since non equipment such as vacuum pump that generates great noise is required in the forming section of the present invention, the operating environment of the worker is greatly improved.

Furthermore, the forming section of fourdrinier according to the preferred embodiment of the present invention comprises at least one scraping blade 11 arranged at an outer position of the couch roll 5 and maintained in contact with the forming mesh 2 to prevent water removed from the wet fabric web 8 from wetting the wet fabric web 8 again, and to prevent the evenness of the wet fabric web 8 from being damaged when the operating speed of the forming section of fourdrinier is low.

The forming section of fourdrinier according to the preferred embodiment of the present invention further provides a fabric mesh roll 13 arranged before a separation point of the fabric mesh 4 and the forming mesh 2, wherein the separation point of the fabric mesh 4 and the forming mesh 2 is positioned after the pressing zone. The forming section of the preferred embodiment further comprises a transferring device 12 provided between the separation point and the pressing zone for transferring the wet fabric web 8 on the forming mesh 2 to the fabric mesh 4, wherein the transferring device 12 is embodied as a blower unit 12 arranged on a back side the forming mesh 2 for reducing the wear on the front surface of the forming mesh 2, reducing the power consumption, and prolonging the service life span of the forming mesh 2.

In addition, according to the preferred embodiment of the present invention, a linear pressure between the press roll 10 and the couch roll 5 can be set to not less than 400~600 kgf/cm, preferably 400 kgf/cm, 500 kgf/cm or 600 kgf/cm, in order to achieve the best pressing and squeezing effect for removing water. A tension of the forming mesh 2 can be set to be not less than 10~15 kgf/cm, preferably 10 kgf/cm or 15 kgf/cm. An including angle of the forming mesh 2 on the couch roll 5 is larger than or equal to 60° (preferable 180° according to the preferred embodiment), so that a centrifugal force of the couch roll 5 can be fully utilized for dewatering/dehydration with lower dewatering/dehydration cost.

The forming section of fourdrinier according to the present invention has the advantages of simple structure, convenient operation and usage, low power consumption, good dewatering capacity, and practicability.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A forming section of fourdrinier, comprising:

a rotatable breast roll;

a rotatable couch roll;

a forming mesh movably provided between said breast roll and said couch roll, wherein said forming mesh is extended tangential to a lower position of said couch roll defining a first tangent point, wherein an angle of said forming mesh on said couch roll is set at least 60° to allow said couch roll generating a centrifugal force to be fully utilized for dewatering said forming mesh;

a fabric mesh which is extended tangential to said couch roll at a second tangent point which is coincided with said first tangent point of said forming mesh and said couch roll, wherein at least an outer side of said fabric mesh and an inner side of said forming mesh are overlappedly attached on a portion of an outer surface of said couch roll;

a headbox arranged above said breast roll for flowing pulp contained in said headbox to said forming mesh;

a wet fabric web formed on a front surface of said forming mesh;

a dewatering unit provided at a rear side of said forming mesh for scraping off water on said forming mesh and forming a vacuum zone on said forming mesh;

a rotatable press roll arranged pressing against said couch roll, wherein a pressing zone is formed between said press roll and said couch roll for pressing and squeezing said wet fabric web formed on said front side of said forming mesh to remove water thereof, wherein said dewatering unit is located before said pressing zone;

a fabric mesh roll located at a position before a separation point of said fabric mesh and said forming mesh, wherein said separation point is defined at a position after said pressing zone; and a vacuum water suction unit arranged below said forming mesh and in front of said first tangent point of said couch roll and said forming mesh, wherein said vacuum water suction unit is formed with said dewatering unit and is located before said pressing zone, wherein said vacuum water suction unit has a shape selected from the group consisting of triangular shape and trapezoidal shape, wherein said dewatering unit is an oblique side of said vacuum water suction unit provided at said rear side of said forming mesh serving as said dewatering unit for scraping off the water on said forming mesh.

2. The forming section of fourdrinier, as recited in claim 1, further comprising at least one scraping blade arranged at an outer position of said couch roll and maintained in contact with said forming mesh to prevent water removed from said fabric web from wetting said wet fabric web again, wherein said at least one scraping blade is located before said pressing zone.

3. The forming section of fourdrinier, as recited in claim 1, further comprising a transferring device provided between said separation point and said pressing zone for transferring said wet fabric web on said forming mesh to said fabric mesh from said press roll to said mesh roll.

4. The forming section of fourdrinier, as recited in claim 3, wherein said transferring device is a blower unit arranged on a back side of said forming mesh.

5. The forming section of fourdrinier, as recited in claim 1, wherein a linear pressure between said press roll and said couch roll is larger than or equal to 400 to 600 kgf/cm.

6. The forming section of fourdrinier, as recited in claim 1, wherein a linear pressure between said press roll and said couch roll is larger than or equal to a value selected from the group consisting of 400 kgf/cm, 500 kgf/cm and 600 kgf/cm.

7. The forming section of fourdrinier, as recited in claim 1, wherein a tension of said forming mesh is larger than or equal to 10 to 15 kgf/cm.

8. The forming section of fourdrinier, as recited in claim 1, wherein a tension of said forming mesh is larger than or equal to one of 10 kgf/cm and 15 kgf/cm.

9. The forming section of fourdrinier, as recited in claim 1, wherein said angle of said forming mesh on said couch roll is 180°, such that said forming mesh movably provided between said breast roll and said couch roll in a horizontal manner.

10. A forming section of fourdrinier, comprising:

a rotatable breast roll;

a rotatable couch roll;

a forming mesh movably provided between said breast roll and said couch roll, wherein said forming mesh is extended tangential to a lower position of said couch roll defining a first tangent point, wherein an angle of said forming mesh on said couch roll is set at least 60° to allow said couch roll generating a centrifugal force to be fully utilized for dewatering said forming mesh;

a fabric mesh which is extended tangential to said couch roll at a second tangent point which is positioned before said first tangent point of said forming mesh and said couch roll, wherein at least an outer side of said fabric mesh and an inner side of said forming mesh are overlappedly attached on a portion of an outer surface of said couch roll;

a headbox arranged above said breast roll for flowing pulp contained in said headbox to said forming mesh;

a wet fabric web formed on a front surface of said forming mesh;

a dewatering unit provided at a rear side of said forming mesh for scraping off water on said forming mesh and forming a vacuum zone on said forming mesh;

a rotatable press roll arranged pressing against said couch roll, wherein a pressing zone is formed between said press roll and said couch roll for pressing and squeezing said wet fabric web formed on said front side of said forming mesh to remove water thereof, wherein said dewatering unit is located before said pressing zone;

a fabric mesh roll located at a position before a separation point of said fabric mesh and said forming mesh, wherein said separation point is defined at a position after said pressing zone; and a vacuum water suction unit arranged below said forming mesh and in front of said first tangent point of said couch roll and said forming mesh, wherein said vacuum water suction unit is formed with said dewatering unit and is located before said pressing zone, wherein said vacuum water suction unit has a shape selected from the group consisting of triangular shape and trapezoidal shape, wherein said dewatering unit is an oblique side of said vacuum water suction unit provided at said rear side of said forming mesh serving as said dewatering unit for scraping off water on said forming mesh.

11. The forming section of fourdrinier, as recited in claim 10, further comprising at least one scraping blade arranged at an outer position of said couch roll and maintained in contact with said forming mesh to prevent water removed from said fabric web from wetting said wet fabric web again, wherein said at least one scraping blade is located before said pressing zone.

12. The forming section of fourdrinier, as recited in claim 10, further comprising a transferring device provided between said separation point and said pressing zone for transferring said wet fabric web on said forming mesh to said fabric mesh from said press roll to said mesh roll.

13. The forming section of fourdrinier, as recited in claim 12, wherein said transferring device is a blower unit arranged on a back side of said forming mesh.

14. The forming section of fourdrinier, as recited in claim 10, wherein a linear pressure between said press roll and said couch roll is larger than or equal to 400 to 600 kgf/cm.

15. The forming section of fourdrinier, as recited in claim 10, wherein a linear pressure between said press roll and said couch roll is larger than or equal to a value selected from the group consisting of 400 kgf/cm, 500 kgf/cm and 600 kgf/cm.

16. The forming section of fourdrinier, as recited in claim 10, wherein a tension of said forming mesh is larger than or equal to one of 10 to 15 kgf/cm.

17. The forming section of fourdrinier, as recited in claim 10, wherein a tension of said forming mesh is larger than or equal to one of 10 kgf/cm and 15 kgf/cm.

18. The forming section of fourdrinier, as recited in claim 10, wherein said angle of said forming mesh on said couch roll is 180°, such that said forming mesh movably provided between said breast roll and said couch roll in a horizontal manner.

* * * * *